US005080515A

United States Patent [19]

Engelhardt et al.

[11] Patent Number: 5,080,515

[45] Date of Patent: Jan. 14, 1992

[54] DUAL SHEET FEED DEVICE FOR AN OFFICE MACHINE SUCH AS A MATRIX PRINTER

[75] Inventors: Günter Engelhardt, Niederstotzingen; Gerhard Lohrmann, Elchingen/Thalfingen, both of Fed. Rep. of Germany

[73] Assignee: Mannesmann Aktiengesellschaft, Düsseldorf, Fed. Rep. of Germany

[21] Appl. No.: 510,850

[22] Filed: Apr. 18, 1990

Related U.S. Application Data

[63] Continuation-in-part of Ser. No. 166,620, Mar. 11, 1988, abandoned.

[30] Foreign Application Priority Data

Mar. 12, 1987 [DE] Fed. Rep. of Germany ..... 3707886

[51] Int. Cl.[5] ..... B41J 13/10

[52] U.S. Cl. ..... 400/624; 400/625; 400/629

[58] Field of Search ..... 400/605, 624, 628, 629, 400/634, 636, 636.2, 637.1, 625; 271/9, 109, 113

[56] References Cited

U.S. PATENT DOCUMENTS

| | | | |
|---|---|---|---|
| 4,222,557 | 9/1980 | Wu | 400/625 |
| 4,577,849 | 3/1986 | Watanabe | 271/9 |
| 4,729,680 | 3/1988 | Osterlund et al. | 400/629 |
| 4,770,555 | 9/1988 | Deschamps | 400/624 |

FOREIGN PATENT DOCUMENTS

| | | | |
|---|---|---|---|
| 103842 | 3/1984 | European Pat. Off. | 400/629 |
| 2856950 | 10/1979 | Fed. Rep. of Germany | 400/624 |
| 123833 | 9/1980 | Japan | 271/9 |
| 177236 | 10/1984 | Japan | 400/629 |
| 136842 | 6/1986 | Japan | 271/9 |

*Primary Examiner*—David A. Wiecking
*Attorney, Agent, or Firm*—Horst M. Kasper

[57] ABSTRACT

A device for feeding of individual sheets to a plate (4) of an office machine, in particular of a matrix printer (1), is provided with several storage bins (5, 6). In each case a separating roller (7, 8) is coordinated to the storage bins (5, 6) and the separating roller (7, 8) is connected to a drive motor (9) via a gear train. In order to create a reliably operating storage bin selection, which can be employed for larger distances and for larger-volume storage bins, it is disclosed that the drive motor (9) can be left-hand or right-hand rotatably controlled, that the drive motor pinion (10) engages a first gear wheel (11), that an eccentrically supported cam (12) is carried by the first gear wheel (11), that the cam (12) engages into a switching rocker (13), and that at least a second gear wheel (15) is rotatably supported at the switching rocker (13) supported around a horizontal axle (14), where the second gear wheel (15) is tilted, depending on the rotary direction of the drive motor (9), into engagement with the respective gear wheel (16, 17) of one of the separating rollers (7, 8).

35 Claims, 3 Drawing Sheets

DUAL SHEET FEED DEVICE FOR AN OFFICE MACHINE SUCH AS A MATRIX PRINTER

CROSS REFERENCE TO RELATED APPLICATIONS

This application is a continuation-in-part application of another application filed Mar. 11, 1988 and bearing U.S. Ser. No. 07/166,620, now abandoned. The entire disclosure of this latter application, including the drawings thereof, is hereby incorporated in this application as if fully set forth herein.

BACKGROUND OF THE INVENTION

1. Field of the Invention

The invention relates to a device for the feeding of individual sheets to a plate of an office machine, in particular of a matrix printer, employing several storage bins, of which storage bins one is coordinated to a separating roller rotatably supported at a spatially fixed axle, and which separating roller is connected via a gear train to a drive motor.

2. Brief Description of the Background of the Invention Including Prior Art

Such devices for the feeding of individual sheets into the chute of a plate or of a differently formed print-support surface require in many cases only one storage bin and only one receiver or discharge bin. Because of the distance of several storage bins and because of the separating rollers required in each case, the solutions of known devices cannot be employed in the instant case.

It is known from German Patent DE-PS 2,856,950 to provide in each case one separating roller for several storage bins. Such a device is deemed necessary in order to safely and reliably achieve the separation and individualization of the sheets or, respectively, of the forms. The construction of such a separating roller axle with several individual separating rollers at each storage bin is however also necessary in order to maintain the stack of sheets in a slightly inclined position, in which a springing support surface presses the remaining sheet stack in each case into the separation position against the separating rollers. Such a slightly inclined disposition of the sheet stack is in addition advantageous from ergonomic points of view, since the operating personnel requires a corresponding accessibility or, respectively, overview over the available sheet stack.

In addition, a separating device for two oppositely disposed storage bins is known from United Kingdom Patent Application 2,022,059. One single separating roller is disposed between the two storage bins and can be tilted in the two separating positions. This system however is associated with the disadvantage that the position of the separating roller has to be determined exactly after each tilting process because otherwise the contact pressure force of the springing support surface, on which the sheet stack rests, is changed and thus the separating force.

SUMMARY OF THE INVENTION

Purposes of the Invention

It is an object of the invention to provide a reliably operating storage bin selector which can be employed for larger bin distances and for larger storage bins.

It is another object of the invention to provide a simple control system allowing switching between two bins in an office machine.

It is yet another object of the present invention to provide a selection system for storage bins which minimizes the number of motors required for feed selection purposes.

These and other objects and advantages of the present invention will become evident from the description which follows.

Brief Description of the Invention

The present invention provides for a device for feeding of individual sheets to a print roller of an office machine comprising a frame and at least two storage bins furnished at the frame. A bi-directional drive motor is attached to the frame and includes a pinion. A first gear wheel is mounted on the frame with the drive motor pinion engaging the first gear wheel. An eccentrically supported cam is supported by the first gear wheel. A switching rocker is supported around a horizontal axle and engaged by the cam. A first and a second separating roller are rotatably supported by the frame at a spatially fixed axle, coordinated to one of the storage bins. A fifth gear wheel 16 is fixedly connected to the first separating roller. A sixth gear wheel 17 is fixedly connected to the second separating roller. A second gear wheel is rotatably supported at the switching rocker. The rotation of the motor causes the second gear wheel to be tilted into direct engagement with the fifth gear wheel when the motor is rotated in one direction and into direct engagement with the sixth gear wheel when the motor is rotated in the opposite direction. This will transmit the rotation of the print roller 4 through the gear train 24 to the selected fifth or sixth gear wheel, as is known in the art.

A print head carriage can be attached to the frame and a matrix print head can be mounted on the print head carriage, such as disclosed, for example, in U.S. patent application Ser. No. 137,437, filed Dec. 23, 1987, and entitled "Matrix Print Head."

A spring wire clip can have two arms, wherein the cam disposed on the first gear wheel can be supported between the arms of the spring wire clip.

A print roller gear wheel can be attached to the axle of the print roller. A third gear wheel can be rotatably supported at the switching rocker. The third gear wheel can be engaged with the second gear wheel and can engage in addition the teeth of the print roller gear wheel via a gear train. The switching rocker can be rotatably supported around the horizontal axle of the third gear wheel.

One of the storage bins can be a discharge bin for printed individual sheets having an input edge and being attached to the frame. An axle for transport rollers can be rotatably attached to the frame for supporting the transport rollers. A fourth gear wheel can be disposed on the axle for the transport rollers and can be connected in the region of the input edge of the discharge bin to the gear train. Said gear train thereby driving connects the third gear wheel to the print roller.

Preferably, a guide roller pair is coordinated to the print roller at an output where a guide slot of the guide roller pair runs together with the transport rollers of the discharge bin about along a tangent relative to the transport rollers.

The storage bins, the discharge bin, the separating rollers with respective gear wheels, the drive motor, the switching rocker, and the gear train, as well as the transport rollers can be gathered and attached to the frame, which can be hung on the print roller axle. The frame can be bolted at the printer chassis.

A cam pin of the cam can be supported by the first gear wheel. The switching rocker can be hinged near one end and can engage the axle of the second gear wheel within a middle third of the overall length of the switching rocker. The cam pin and the axle of the second gear wheel can be of substantially the same diameter. The cam pin and the axle of the second gear wheel can be engaged by two substantially parallel arms of the switching rocker.

The method for feeding of individual sheets to a print roller of an office machine comprises the steps of initiating power to the drive motor. Sheets are fed from a first one of the bins to the print support of the office machine. The direction of rotation of the drive motor is reversed. The switching rocker is engaged with a pin and moves the switching rocker in an about opposite direction thereby disengaging the second gear wheel from the fifth gear wheel of the first separating roller. The second gear wheel is engaged with the sixth gear wheel of the second separating roller for changing the input feed bin for paper.

According to the invention, the drive motor is a bidirectionally controllable motor or a reversible motor, which can be controlled to turn left-ward or right-ward, where the drive motor pinion engages a first gear wheel, which carries an eccentrically supported cam. The eccentrically supported cam engages a switching rocker. At least a second gear wheel is rotatably supported at the switching rocker supported around a horizontal axle. The second gear wheel, engaged with a respective gear wheel of a separating roller, is tiltable depending on the direction of rotation of the drive motor. The respective direction of rotation controls the switching rocker by engagement of the gear teeth. Thus, the device does not exhibit any critical parts, which could interfere with the functioning or could lead to an excessive wear. The device therefore operates very reliably. In addition, the tilting motion allows to apply constructively larger storage magazines and a larger distance of such storage bins.

It is provided in a further embodiment of the invention that the cam, disposed on the first gear wheel, is supported between the arms of a spring wire clip. The advantage comprises a freedom of motion of the drive motor. Since the drive motor can operate without feedback, the rotary motion occurs independent of the tooth position of the gear wheels belonging to the separating rollers.

Further features of the invention comprise that a third gear wheel is rotatably supported at the switching rocker, which third gear wheel engages the second gear wheel and which moreover engages teeth via a gear train with a gear wheel, which gear wheel is disposed on the axle of the print roller and that the switching rocker is tiltably supported around the horizontal axle of the third gear wheel. Advantageously, this construction derives a further drive force for the feeding of the individual sheet to the print roller from the force flow of the switching rocker.

A further drive branching is achieved by connecting a fourth gear wheel to the third gear wheel of the gear train drivingly connected to the print roller in the region of the input edge of a discharge bin for printing individual sheets, where transport rollers are disposed on the axle of the fourth gear wheel.

The transport of a finished printed individual sheet can be supported in addition by coordinating to the print roller a guide roller pair at the output, where the guide slot runs about as a tangent relative to the transport rollers with the transport rollers of the discharge bin.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
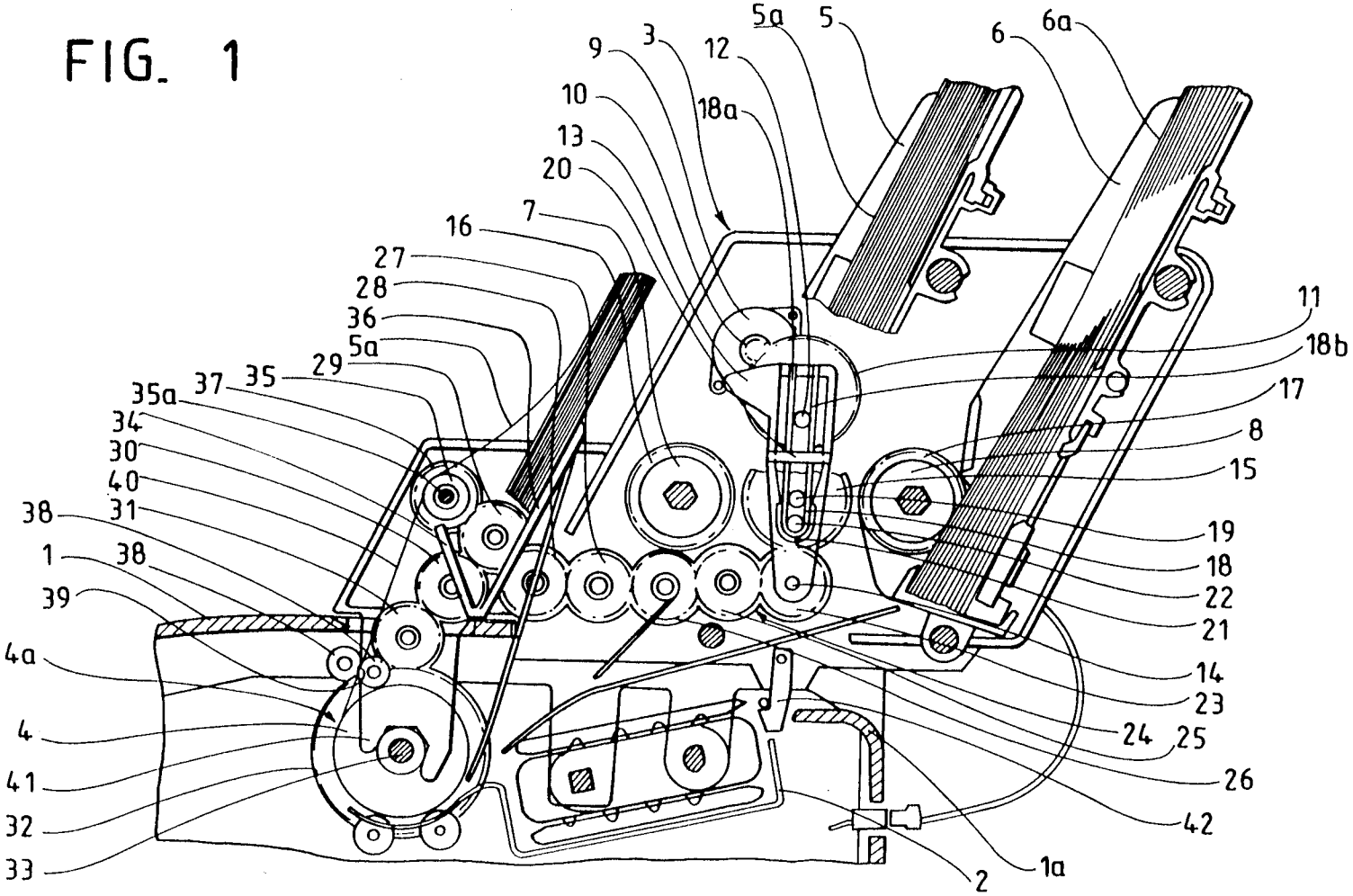
FIG. 1 is a side elevational view of a matrix printer with the switching rocker in neutral position.

In accordance with the present invention there is provided a device for feeding of individual sheets to a print roller of an office machine, in particular of a matrix printer. The improvement comprises a first and a second storage bin 5, 6. A first separating roller, rotatably supported at a spatially fixed axle, is coordinated to the first storage bin. A second separating roller, rotatably supported at a second spatially fixed axle, is coordinated to the second storage bin. The first or second separating roller 7, 8, respectively, is connected to a drive motor for the platen via a gear train. The drive motor 9 can be controlled for right and left-handed rotation. The drive motor pinion 10 engages part of the gear train and engages a first gear wheel 11. This first gear wheel 11 engages part of the gear train and supports an eccentrically supported cam 12. The cam 12 engages into a switching rocker 13 supported around a horizontal axle 14. At least a second gear wheel 15 is rotatably supported at the switching rocker 13. Rotation of the motor causes the second gear wheel 15 to be tilted into direct engagement with a fifth gear wheel 16 of the separating rollers 7 when the motor 9 is rotated in one direction and into direct engagement with a sixth gear wheel of a second separating roller 8 when the motor 9 is rotated in the opposite direction. The gear wheel 16 represents a fifth gear wheel and the gear wheel 17 represents a sixth gear wheel.

The cam 12, disposed on the first gear wheel 11, can be supported between the arms 18*a*, 18*b* of a spring wire clip 18.

The switching rocker is disposed vertically. A third gear wheel 23 can be rotatably supported at the switching rocker 13. This third gear wheel 23 can be engaged with the second gear wheel 15 and can engage in addition the teeth of a gear wheel 32 via a gear train 24. The gear wheel 32 can be disposed on the axle 33 of the print roller 4. The horizontal axle 14 can rotatably support the switching rocker 13 and the third gear wheel 23.

A fourth gear wheel 37 can be connected in the region of the input edge 34 of the discharge receiver bin 36 for printed individual sheets 5*a*, 6*a* to the gear train 24. The gear train 24 can drivingly connect the third gear wheel 23 to the print roller 4. The transport rollers 35 can be disposed on the axle 35*a* of the fourth gear wheel 37.

The guide roller pair 38 can be coordinated to the print roller 4 at the output 4*a*. Preferably, the guide slot 39 of the guide roller pair 38 runs together with the transport rollers 35 of the discharge receiver bin 36 about along a tangent 40 relative to the transport rollers 35.

Preferably, at least the storage bins 5, 6, the discharge receiver bin 36, the separating rollers 7, 8 and the fifth gear wheel 16, the drive motor 9, the switching rocker 13 with first gear wheel 11, second gear wheel 15, third gear wheel 23, and the gear train 24, as well as the transport rollers 35 are gathered and attached to a frame 41 which can be hung on the print roller axle 4*b*. The frame 41 can be bolted at the printer chassis 1*a*.

The embodiment illustrated in FIG. 1 is a matrix printer 1, which comprises a tractor 2 for endless print material and a device 3 for the feeding of individual sheets to the print roller 4 with two storage bins 5 and 6. The print roller 4 is in general connected to a so-called paper transport motor.

Figure 3:
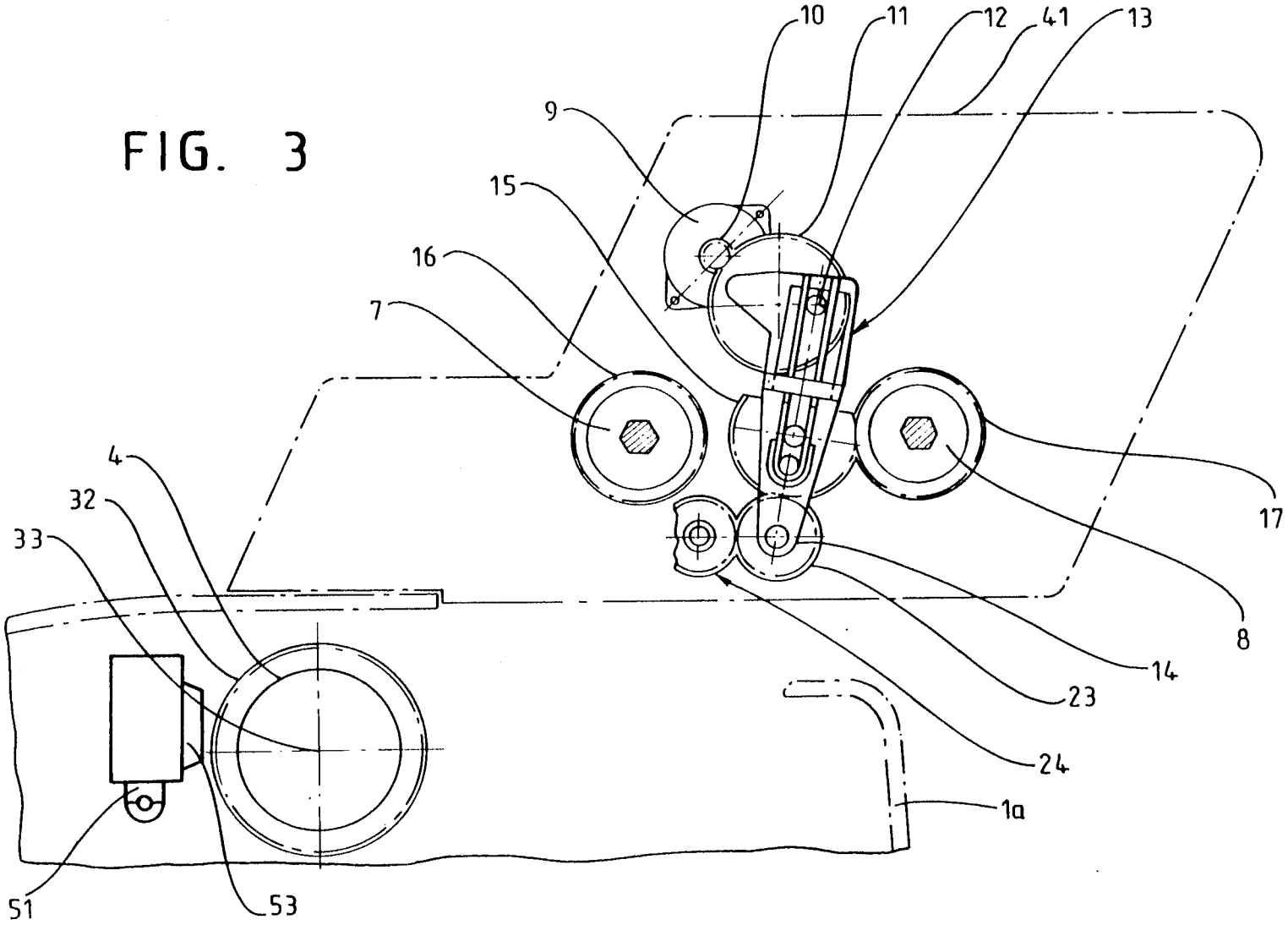
FIG. 3 is a side view of a further embodiment similar to that of FIG. 1.

The matrix printer can comprise other components, e.g. print-head carriage 51 and print head 53 shown in FIG. 3, and furthermore as illustrated in the commonly assigned application filed Jan. 27, 1988, and bearing U.S. Ser. No. 148,318, now pending, with the title "Printer for A Variety of Purposes."

The storage bin 5 has coordinated its own separating roller 7 (roller pair) and the storage bin 6 has also coordinated its own separating roller 8 (roller pair). In principle, a drive motor 9, which advantageously comprises a step motor, drives with its drive motor pinion 10 a first gear wheel 11. The drive motor 9 provides preferably solely a drive for the changing of connection between the two separating rollers 7, 8. This first gear wheel 11 carries an eccentrically disposed cam 12 in the position illustrated in FIG. 1, wherein one switching rocker 13 is disposed in its neutral, vertical position. Preferably, the drive motor 9 serves exclusively to actuate the switching rocker 13, since a small drive motor 9 would not be suitable to provide a driving force to the paper. The paper transport motor for the print roller drives either the separating roller 7 or the separating roller 8 depending on the position of the switching rocker 13. A third gear wheel 23 is rotatably supported at the switching rocker 13, where the third gear wheel 23 is in continuous engagement with the second gear wheel 13. In this case, the switching rocker 13 is tiltably supported around a horizontal axle 14, where the horizontal axle 14 initially can also be disposed at a higher level than that illustrated in FIG. 1. This case occurs if a second gear wheel 15 engages only functionally with a gear wheel 16, which is disposed concentrically on the rotary axle of the separating roller 7, or only engages functionally with a further gear wheel 17, which is disposed concentrically on the rotation axle of the separating roller 8. The second gear wheel 15 does not engage the first gear wheel 11 and consequently no power-transmitting connection exists between the first gear wheel and the second gear wheel 15. The height level of the horizontal axle 14 then determines, however, the tilting path of the switching rocker 13 toward the left and the right in relation to the gear wheels 16 and 17.

The cam 12, attached to the first gear wheel 11, is guided between the arms 18*a* and 18*b* of a spring wire clip 18. In addition, the second gear wheel 15 with its rotation support 19 is maintained between these arms 18*a* and 18*b*. The spring wire clip 18 is secured by a bow 20 against changes in position, as shown in FIG. 1. The spring wire clip 18 is additionally fixed in its longitudinal direction by protrusions 21 and by a shaft bolt 22.

A third gear wheel 23 can be rotatably supported on the horizontal axle 14 at the switching rocker 13. The third gear wheel 23 can be in continuous engagement with the second gear wheel 15. A gear train 24, comprising engaging gear wheels 25, 26, 27, 28, 29, 30, 31, is drivingly connected to the third gear wheel 23. The last gear wheel 31 engages into a print roller gear wheel 32, which is disposed on the axle 33 of the print roller 4. Here, the tilting axle of the switching rocker 13 coincides with the horizontal axle 14 of the third gear wheel 23.

A fourth gear wheel 37 is rotatably supported at the gear train 24 in the area of the input edge 34, which gear train 24 transfers the drive force of the third gear wheel 23. The fourth gear wheel 37 serves for the transport of printed individual sheets 5*a* or, respectively, 6*a* into the discharge receiver bin 36. Transport rollers 35 are disposed on the axle 35*a* of the fourth gear wheel 37, which cooperate under frictional engagement with the respective individual sheet 5*a* or, respectively, 6*a*. The individual sheets 5*a* and 6*a* pass into the sphere of influence of the transport rollers 35 by having a guide roller pair 38 following to the print roller 4 at the output 4*a*. The guide roller pair 38 forms a tangent 40 with its guide slot 39, together with the transport rollers 35 of the discharge bin 36.

A frame 41 is hung on top of the matrix printer 1 on the print roller axle 33. The frame 41 is locked by disengageable locking means 42 at the printer chassis 1*a*. The frame 41 carries in this case, in addition to the storage bins 5 and 6, the discharge receiver bin 36, the separating rollers 7 and 8 with the gear wheels 16 and 17, the drive motor 9, the switching rocker 13 with the gear wheels 11, 15, and 23, the gear train 24, and the fourth gear wheel 37.

Figure 2:
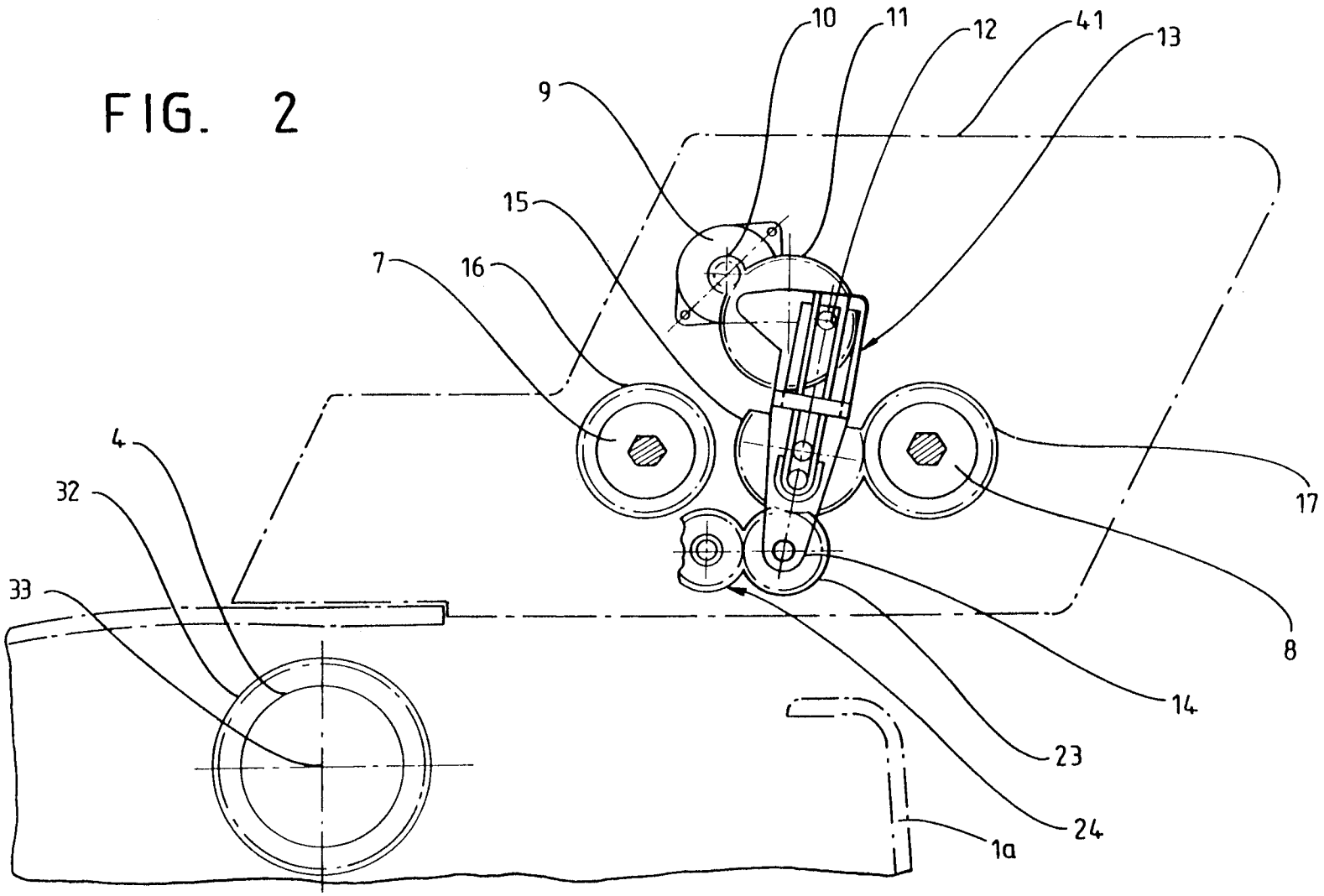
FIG. 2 is a side view according to FIG. 1, however simplified and with one of the possible operation positions of the switcher rocker.

In FIG. 2 it is illustrated that, upon right-direction drive control of the drive motor 9, the switching rocker 13 is tilted via the drive motor pinion 10 and the first gear wheel 11 via the cam 12 such that the second gear wheel 15 engages into the gear wheel 17 of the separating roller 8 and thus individual sheets 6*a* are withdrawn from the storage bin 6.

The separating rollers are covered with an elastic material suitable for frictionally engaging individual sheets of paper. The paths of paper corresponding to separation rollers 7, 8 are joined at a single path employing guide plates. The paper sheets are substantially redirected by the print roller 4 into the guide roller pair 38 and pass from there to the transport rollers 35 of the discharge receiver bin 36.

It will be understood that each of the elements described above, or two or more together, may also find a useful application in other types of sheet feed devices differing from the types described above.

While the invention has been illustrated and described as embodied in the context of an individual sheet feed device for an office machine, such as a matrix printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A device for feeding of individual sheets to a print roller of an office machine comprising a frame;

at least two storage bins furnished at the frame;

a bi-directional drive motor attached to the frame and including a drive motor pinion;

a first gear wheel mounted on the frame with the drive motor pinion engaging the first gear wheel;

an eccentrically supported cam supported by the first gear wheel;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to one of the storage bins;

a fifth gear wheel fixedly connected to the first separating roller;

a sixth gear wheel fixedly connected to the second separating roller;

a second gear wheel rotatably supported at the switching rocker, wherein rotation of the motor causes the second gear wheel to be tilted into direct engagement with the fifth gear wheel when the motor is rotated in one direction and into direct engagement with the sixth gear wheel when the motor is rotated in the opposite direction.

2. The device for feeding of individual sheets according to claim 1, further comprising a print head carriage attached to the frame;

a matrix print head mounted on the print head carriage.

3. The device for feeding of individual sheets according to claim 1, further comprising a print roller;

a print roller gear wheel attached to the axle of the print roller;

a third gear wheel rotatably supported at the switching rocker, which third gear wheel is engaged with the second gear wheel and which third gear wheel engages in addition the teeth of the print roller gear wheel via a gear train, and wherein the switching rocker is rotatably supported around the horizontal axle of the third gear wheel.

4. The device for feeding of individual sheets according to claim 1, wherein one of the storage bins is a discharge bin for printed individual sheets having an input edge and attached to the frame;

and further comprising a print roller;

transport rollers;

an axle for the transport rollers rotatably attached to the frame for supporting the transport rollers;

a fourth gear wheel disposed on the axle for the transport rollers and connected in the region of the input edge of the discharge bin to a gear train, said gear train thereby drivingly connecting a third gear wheel to the print roller.

5. The device for feeding of individual sheets according to claim 4, further comprising a guide roller pair coordinated to the print roller at an output where a guide slot of the guide roller pair runs together with transport rollers of the discharge bin about along a tangent relative to the transport rollers.

6. The device for feeding of individual sheets according to claim 4, wherein the storage bins, the discharge bin, the separating rollers with respective gear wheels, the drive motor, the switching rocker, and the gear train, as well as the transport rollers are gathered and attached to the frame, which can be hung on the print roller axle, and where the frame can be bolted at the printer chassis.

7. The device for feeding of individual sheets according to claim 1, wherein a cam pin of the cam is supported by the first gear wheel; wherein the switching rocker is hinged near one end and engages an axle of the second gear wheel within a middle third of the overall length of the switching rocker.

8. The device for feeding of individual sheets according to claim 1, wherein the first gear is pivotable around a first pivoting axis, wherein the separating rollers have a respective axle and wherein the pivoting axis of the first gear wheel is disposed within a prism having an equilateral triangular cross section and wherein the base of the triangle is formed by a straight perpendicular line between axles of the separating rollers.

9. The device for feeding of individual sheets according to claim 1, wherein a pivoting axis of the first gear wheel is disposed within a cylinder having a circular cross section with a diameter corresponding to the distance between the axes of the two separating rollers and where the cylinder is defined by the axes of the two separating rollers form tangents to the cylinder with said tangents running in parallel to the axis of the cylinder.

10. The device for feeding of individual sheets according to claim 1, wherein an axle of the second gear wheel is disposed at all operating times within a body formed by the two separating rollers together with their connecting outer tangent planes.

11. The device for feeding of individual sheets according to claim 1, wherein the second gear wheel remains at all times at least in part within the confines defined by a mathematical body formed by the two separating rollers together with their connecting outer tangent planes.

12. The device for feeding of individual sheets according to claim 1, wherein the second gear wheel is the only force transmitting gear wheel contacting the fifth and sixth gear wheel.

13. The device for feeding of individual sheets according to claim 1, wherein the connection line between the axle of the switching rocker and the eccentrically supported cam intersects a straight connection line between the axes of the two separating rollers.

14. The device for feeding of individual sheets according to claim 1, wherein the connection line between the axle of the switching rocker and the eccentrically supported cam in a middle disengaged position forms an acute angle with a straight connection line between the axes of the two separating rollers.

15. A device for feeding of individual sheets to a roller of an office machine comprising a frame;

at least two storage bins furnished at the frame;

a bi-directional drive motor attached to the frame and including a drive motor pinion;

a first gear wheel mounted on the frame with the drive motor pinion engaging the first gear wheel;

an eccentrically supported cam supported by the first gear wheel;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with the fifth gear wheel when the motor is rotated in one direction and into direct engagement with the sixth gear wheel when the motor is rotated in the opposite direction;

a spring wire clip having two arms, wherein the cam disposed on the first gear wheel is supported between the arms of the spring wire clip.

16. A device for feeding of individual sheets to a roller of an office machine, comprising a frame;

at least two storage bins furnished at the frame;

a bi-directional drive motor attached to the frame and including a drive motor pinion;

a first gear wheel mounted on the frame with the drive motor pinion engaging the first gear wheel;

an eccentrically supported cam supported by the first gear wheel;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with the fifth gear wheel when the motor is rotated in one direction and into direct engagement with the sixth gear wheel when the motor is rotated in the opposite direction;

wherein a cam pin of the cam is supported by the first gear wheel;

wherein the switching rocker is hinged near one end and engages an axle of the second gear wheel within a middle third of the overall length of the switching rocker; and wherein the cam pin and the axle of the second gear wheel are of substantially the same diameter and where the cam pin and the axle of the second gear wheel are engaged by two substantially parallel arms of the switching rocker.

17. A device for feeding of individual sheet to a print roller of an office machine, in particular of a matrix printer, wherein the improvement comprises a first storage bin and a second storage bin, and where a first separating roller, rotatably supported at a spatially fixed axle, is coordinated to the first storage bin and a second separating roller, rotatably supported at a second spatially fixed axle, is coordinated to the second storage bin, where the first separating roller or, alternatively, the second separating roller is connected to a gear train, wherein a drive motor (9) can be controlled for right and left-handed rotation, where a drive motor pinion (10) engages part of the hear train and engages a first gear wheel (11), which first gear wheel (11) engages part of the gear train and supports an eccentrically supported cam (12), which cam (12) engages into a switching rocker (13) supported around a horizontal axle (14) and wherein at least a second gear wheel (15) is rotatably supported at the switching rocker (13), wherein rotation of the motor causes the second gear wheel (15) to be tilted into direct engagement with a fifth gear wheel (16) of the separating roller (7) when the motor (9) is rotated in one direction and into direct engagement with a sixth gear wheel of a second separating roller (8) when the motor (9) is rotated in the opposite direction.

18. A device for feeding of individual sheets to a print roller of an office machine, in particular of a matrix printer, wherein the improvement comprises a first storage bin and a second storage bin, and where a first separating roller, rotatably supported at a spatially fixed axle, is coordinated to the first storage bin and a second separating roller, rotatably supported at a second spatially fixed axle, is coordinated to the second storage bin, where the first separating roller or, alternatively, the second separating roller is connected to a drive motor via a gear train, wherein the drive motor (9) can be controlled for right and left-handed rotation, where a drive motor pinion (10) engages part of the gear train and engages a first gear wheel (11), which first gear wheel (11) engages part of the gear train and supports an eccentrically supported cam (12), which cam (12) engages into a switching rocker (13) supported around a horizontal axle (14) and wherein at least a second gear wheel (15) is rotatably supported at the switching rocker (13) wherein rotation of the motor causes the second gear wheel (15) to be tilted into direct engagement with a fifth gear wheel (16) of the separating roller (7) when the motor (9) is rotated in one direction and into direct engagement with a sixth gear wheel of a second separating roller (8) when the motor (9) is rotated in the opposite direction, wherein the cam (12), disposed on the first gear wheel (11), is supported between the arms (18*a*, 18*b*) of a spring wire lip (18).

19. The device for feeding of individual sheets according to claim 17, wherein the switching rocker (13) is disposed vertically, wherein a third gear wheel (23) is rotatably supported at the switching rocker (13), which third gear wheel (23) is engaged with the second gear wheel (15) and which third gear wheel (23) engages in addition the teeth of a gear wheel (32) via the gear train (24-31), which gear wheel (32) is disposed on an axle (33) of a print roller (4) and where the horizontal axle (14) supports rotatably the switching rocker (13) and the third gear wheel (23).

20. The device for feeding of individual sheets according to claim 17, wherein a fourth gear wheel (37) is connected in the region of the input edge (34) of a discharge receiver bin (36) for printed individual sheets (5*a*, 6*a*) to the gear train (24-31), said gear train (24-31) drivingly connecting the third gear wheel (23) to a print roller (4), where transport rollers (35) are disposed on an axle (35*a*) of the fourth gear wheel (37).

21. The device for feeding of individual sheets according to claim 17, wherein a guide roller pair (38) is coordinated to a print roller (4) at the output (4*a*), where a guide slot (39) of the guide roller pair (38) runs together with transport rollers (35) of a discharge receiver bin (36) about along a tangent (40) relative to the transport rollers (35).

22. The device for feeding of individual sheets according to claim 17, wherein at least the storage bins (5, 6), a discharge receiver bin (36), the separating rollers (7, 8) and the fifth gear wheel (16), the drive motor (9), the switching rocker (13) with first gear wheel (11), second gear wheel (15), third gear wheel (23), and the gear train (24-31), as well as the transport rollers (35) are gathered and attached to a frame (41) which can be hung on a print roller axle (4*b*), and where the frame (41) can be bolted at the printer chassis (1*a*).

23. A method for feeding of individual sheets to a print roller of an office machine wherein the office machine includes a frame;

at least two storage bins furnished at the frame;

a bi-directional drive motor attached to the frame and including a drive motor pinion;

a first gear wheel mounted on the frame with the drive motor pinion engaging the first gear wheel;

an eccentrically supported cam supported by the first gear wheel;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with a fifth gear wheel of the first separating roller when the motor is rotated in one direction and into direct engagement with the sixth gear wheel of the second separating roller when the motor is rotated in the opposite direction;

comprising the steps of initiating power to the drive motor;

feeding sheets from a first one of the bins to a print support of the office machine;

reversing the direction of rotation of the drive motor;

engaging the switching rocker with a pin and moving the switching rocker in an about opposite direction thereby disengaging the second gear wheel from the fifth gear wheel of the first separating roller and engaging the second gear wheel with the sixth gear wheel of the second separating roller for changing the input feed bin for paper.

24. The device for feeding of individual sheets according to claim 1, wherein the switching rocker pivots around the horizontal axle, wherein the first gear wheel is pivotably supported and wherein the horizontal axle of the switching rocker is disposed opposite to a pivoting axis of the first gear wheel relative to a plane spanned by the axes of the separating rollers.

25. The device for feeding of individual sheets according to claim 24, wherein the switching rocker is pivotably supported and wherein the horizontal axle of the switching rocker is disposed with a prism having an equilateral triangular cross section and wherein the base of the triangle is formed by a straight perpendicular line between axles of the separating rollers.

26. The device for feeding of individual sheets according to claim 24, wherein the separating rollers are pivotably supported and wherein the pivoting axis of the switching rocker is disposed within a cylinder having a circular cross section with a diameter corresponding to the distance between the axes of the two separating rollers and where the axes of the two separating rollers form a tangent parallel to the axis of the cylinder.

27. A device for feeding of individual sheets to a print roller of an office machine comprising a frame;

at least two storage bins furnished at the frame;

a bi-directional drive motor attached to the frame and including a drive motor pinion;

a first gear wheel section pivotably mounted on the frame with the drive motor pinion engaging the first gear wheel section;

an eccentrically supported cam supported by the first gear wheel section;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to a second one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with the fifth gear wheel when the motor is rotated in one direction.

28. A device for feeding of individual sheets to a print roller of an office machine comprising a frame;

at least two storage bins furnished at the frame;

a bi-directional drive motor attached to the frame and including a drive motor pinion;

a first gear wheel section pivotably mounted on the frame with the drive motor pinion engaging the first gear wheel section;

an eccentrically supported cam supported by the first gear wheel section;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to a second one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with the fifth gear wheel when the motor is rotated in one direction;

a spring wire clip having two arms, wherein the cam disposed on the first gear wheel section is supported between the arms of the spring wire clip.

29. The device for feeding of individual sheets according to claim 27, further comprising a print roller;

a print roller gear wheel attached to the axle of the print roller;

a third gear wheel rotatably supported at the switching rocker, which third gear wheel is engaged with the second gear wheel and which third gear wheel engages in addition the teeth of the print roller gear wheel via a gear train, and wherein the switching rocker is rotatably supported around the horizontal axle of the third gear wheel.

30. The device for feeding of individual sheets according to claim 27, wherein one of the storage bins is a discharge bin for printed individual sheets having an input edge and attached to the frame;

and further comprising a print roller;

transport rollers;

an axle for the transport rollers rotatably attached to the frame for supporting the transport rollers;

a fourth gear wheel disposed on the axle for the transport rollers and connected in the region of the input edge of the discharge bin to a gear train.

31. The device for feeding of individual sheets according to claim 30, further comprising a guide roller pair coordinated to the print roller at an output where a guide slot of the guide roller pair runs together with transport rollers of the discharge bin about along a tangent relative to the transport rollers.

32. The device for feeding of individual sheets according to claim 30, wherein the storage bins, the discharge bin, the separating rollers with respective gear wheels, the drive motor, the switching rocker, and the gear train, as well as the transport rollers are gathered and attached to the frame, which can be hung on the print roller axle, and where the frame can be bolted at the printer chassis.

33. The device for feeding of individual sheets according to claim 27, wherein a cam pin of the cam is supported by the first gear wheel section;

wherein the switching rocker is hinged near one end and engages an axle of the second gear wheel within a middle third of the overall length of the switching rocker.

34. A device for feeding of individual sheets to a print roller of an office machine comprising a frame;

at least two storage bins furnished at the frame;

a bi-directional drive motor attached to the frame and including a drive motor pinion;

a first gear wheel section pivotably mounted on the frame with the drive motor pinion engaging the first gear wheel section;

an eccentrically supported cam supported by the first gear wheel section;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to a second one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with the fifth gear wheel when the motor is rotated in one direction;

wherein a cam pin of the cam is supported by the first gear wheel section;

wherein the switching rocker is hinged near one end and engages an axle of the second gear wheel within a middle third of the overall length of the switching rocker;

wherein the cam pin and the axle of the second gear wheel are of substantially the same diameter and where the cam pin and the axle of the second gear wheel are engaged by two substantially parallel arms of the switching rocker.

35. A device for feeding of individual sheets to a print roller of an office machine comprising a frame;

at least two storage bins furnished at the frame;

a bi-directional drive motor attached to the frame and including a drive motor pinion;

a first gear wheel section pivotably mounted on the frame with the drive motor pinion engaging the first gear wheel section;

an eccentrically supported cam supported by the first gear wheel section;

elastic guiding means having two arms for guiding the cam between the arms;

a switching rocker supported around a horizontal axle and engaged by the cam;

a first separating roller rotatably supported by the frame at a spatially fixed axle, coordinated to one of the storage bins;

a second separating roller rotatably supported by the frame at a spatially fixed axle, coordinated to one of the storage bins;

a fifth gear wheel fixedly connected to the first separating roller;

a sixth gear wheel fixedly connected to the second separating roller;

a second gear wheel rotatably supported at the switching rocker wherein rotation of the motor causes the second gear wheel to be tilted into direct engagement with the sixth gear wheel when the motor is rotated in a reverse direction.

* * * * *